US005423372A

United States Patent [19]

Kearney

[11] Patent Number: 5,423,372

[45] Date of Patent: Jun. 13, 1995

[54] JOINING SAND CORES FOR MAKING CASTINGS

[75] Inventor: Dolores C. Kearney, West Bloomfield, Mich.

[73] Assignee: Ford Motor Company, Dearborn, Mich.

[21] Appl. No.: 172,954

[22] Filed: Dec. 27, 1993

[51] Int. Cl.[6] ..... B22C 9/10; B22D 33/04

[52] U.S. Cl. ..... 164/137; 164/369

[58] Field of Search ..... 164/137, 339, 340, 369

[56] References Cited

U.S. PATENT DOCUMENTS

| | | |
|---|---|---|
| 3,616,034 | 10/1971 | Obergfell . |
| 3,635,280 | 1/1972 | Parsons . |
| 3,749,628 | 7/1973 | Nancarrow et al. . |
| 3,861,451 | 1/1975 | Bauer et al. . |
| 4,850,739 | 7/1989 | Gargollo . |
| 4,898,635 | 2/1990 | Kobari . |
| 4,932,459 | 6/1990 | Erana . |
| 5,119,882 | 6/1992 | Corbett . |

FOREIGN PATENT DOCUMENTS

| | | | |
|---|---|---|---|
| 62-57735 | 3/1987 | Japan . | |
| 298421 | 5/1971 | U.S.S.R. | 164/137 |

*Primary Examiner*—Kuang Y. Lin

*Attorney, Agent, or Firm*—Joseph W. Malleck; Roger L. May

[57] ABSTRACT

A method of making a sand core assembly, comprising: providing two or more sand cores parts with accurately mating surfaces and an injection port in at least one of the sand core parts that intersects with a desired portion of the mating surfaces, the core parts cooperating to define at least one molding surface; mechanically dry mating the core parts together at the mating surfaces to eliminate any space therebetween except for microfissures at the mating surfaces; and injecting a limited quantity of quick-setting (i.e., organic polyamide) adhesive into the port with a controlled pressure and viscosity effective to migrate the adhesive throughout the port but no further than the microfissures spaced from the molding surface. After the adhesive has set, the mated core assembly parts may be assembled into the mold, iron inserts inductively heated to about 600° F. and molten metal poured into cavity, with only the adhesive to hold the suspended core parts in place.

11 Claims, 4 Drawing Sheets

JOINING SAND CORES FOR MAKING CASTINGS

BACKGROUND OF THE INVENTION

1. Technical Field

This invention relates to the technology of sand core making, and more particularly to bonding sand core parts together to create a complex core assembly that enhances casting quality.

2. Discussion of the Prior Art

Sand core and mold assemblies for making complex metal castings are currently bonded together commercially by use of pastes applied to one of the mating surfaces of the cores to be joined. Pressure is needed to mate the mating core parts together and the use of such pressure often squeezes paste out from between the mating surfaces onto critical molding surfaces for defining the metal casting; the excessive paste will cause defective cast parts. The procedure is also disadvantageous because such mating pressure may impart undue stress to the fragile core parts, causing defects, and requires excessive setting and curing time, often about 30 minutes.

A recent attempt to bond cores together without interrupting critical molding surfaces is disclosed in U.S. Pat. No. 4,932,459 wherein a sand and curable binder mixture is blown into a keyway of a core assembly to mechanically lock the core parts together by groove and tongue coupling. This requires separate sand blowing steps, one for the core parts and one for the keyway, adding to the cost of the procedure. For this approach, the sand core parts must be designed to mate with special overhanging surfaces to make the joint work effectively, part design does not always allow the use of this process particularly with small, fragile cores because a thick core cross-section is needed. Moreover, the joint is not firm and strong because of the lack of adhesive.

SUMMARY OF THE INVENTION

It is an object of this invention to secure sand core parts together mechanically in an assembly held in place structurally only by an adhesive that functions even when heated to about 300° F.; the adhesive desirably is fast setting and is placed at a location in the assembly that eliminates contact with metal during casting and is present in the core assembly during the entire metal casting process.

The invention in a first aspect is a method of making a sand core assembly, comprising: (a) providing two or more sand cores parts with accurately mating surfaces and an injection port in at least one of said sand core parts that intersects with a desired portion of the mating surfaces, said core parts cooperating to define at least one molding surface; (b) mechanically mating said core parts together at said mating surfaces to eliminate any space therebetween except for microfissures at the mating surfaces; and (c) injecting a limited quantity of quick setting organic polyamide adhesive into said port with a controlled pressure effective to migrate the adhesive into said microfissures spaced from said molding surface.

A second aspect of this invention is a method of metal casting, comprising (a) making two or more sand core parts for assembly at predetermined accurate mating surfaces, at least one of said core parts having an injection port that intersects with a desired portion of the mating surfaces, the core parts cooperating to define at least one molding surface; (b) dry mating of the core parts in an exact desired relationship to eliminate any space therebetween except for microfissures at the mating surfaces; (c) injecting a quick setting organic adhesive into said port with sufficient pressure to cause migration of the adhesive into microfissures spaced from said molding surface; and (d) after the adhesive has set, placing the mated core assembly parts into a sand mold and pouring molten metal into the mold cavity of the mold that subjects the adhesive to high heat prior to form a cast metal part.

DETAILED DESCRIPTION AND BEST MODE

Core paste is often used to bond two or more sand cores together. A core paste is useful even though the complex core assemblies use core prints to locate and nest the cores together. Complex core assemblies are often used for complex heads of internal combustion engines or for engine blocks having a variety of internal passages that must be defined by a multiple core assembly.

Figure 1:
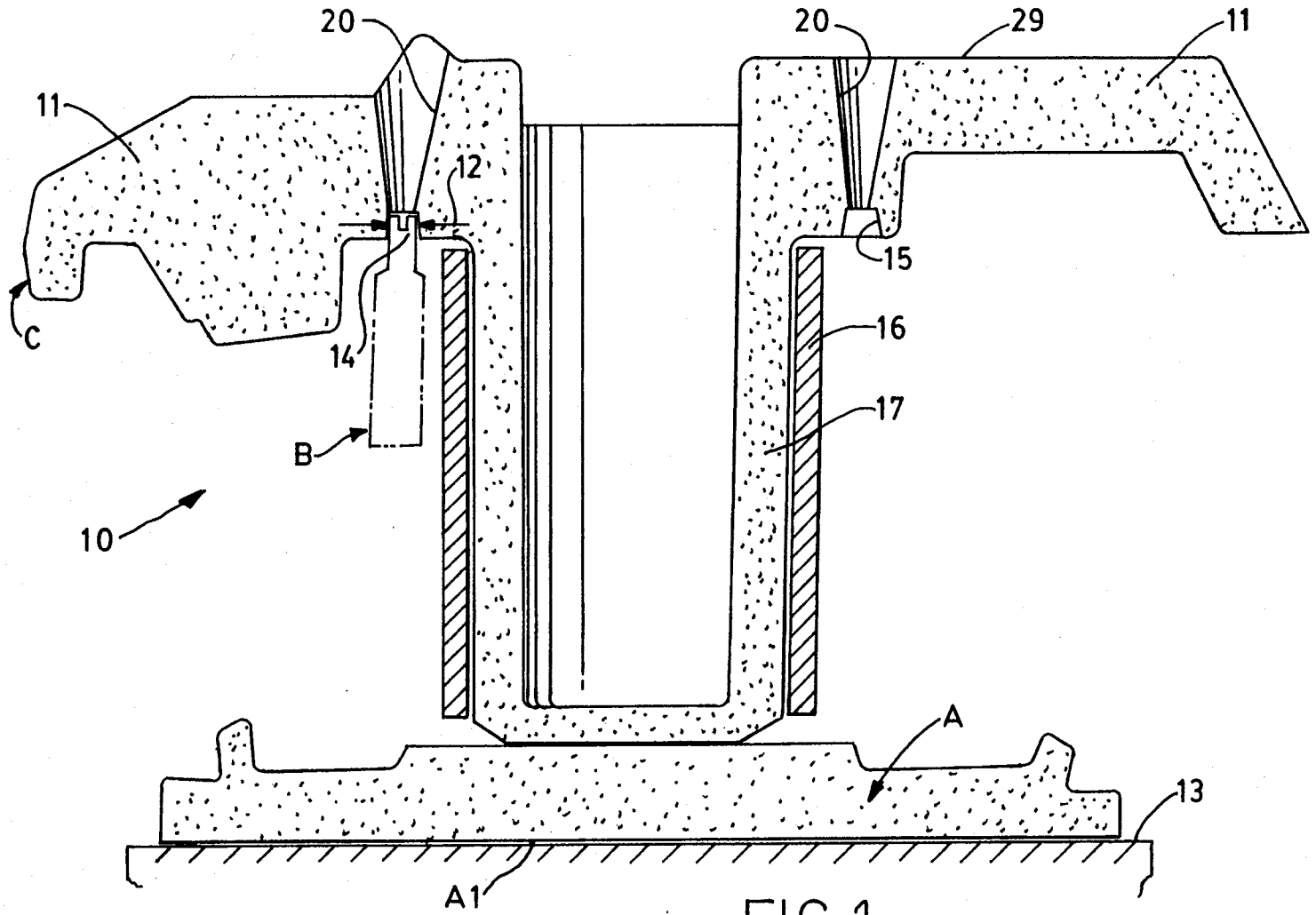
FIG. 1 is a central sectional view of two core parts mated and joinable according to the principles of this invention.
Figure 2:
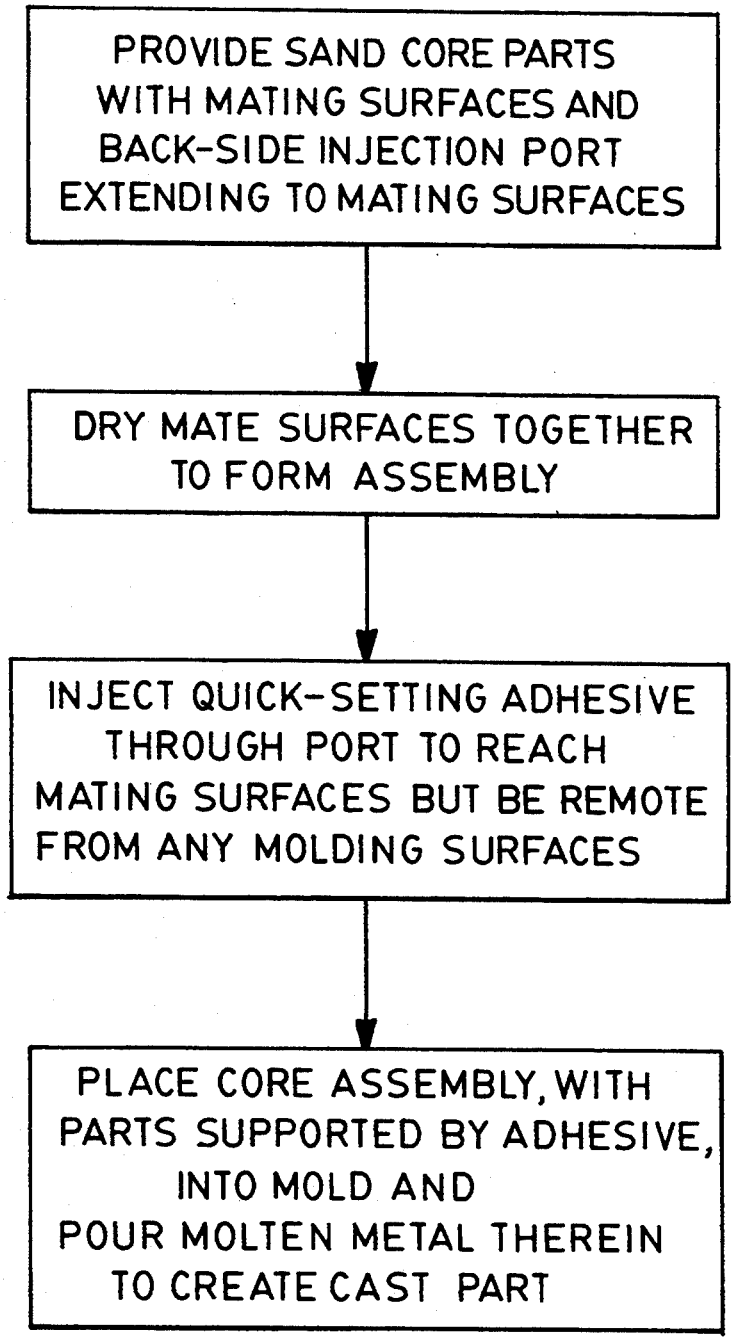
FIG. 2 is a flow diagram (in full line) for the method of making sand core assemblies in accordance with this invention and in dotted line for casting a part.
Figure 3:
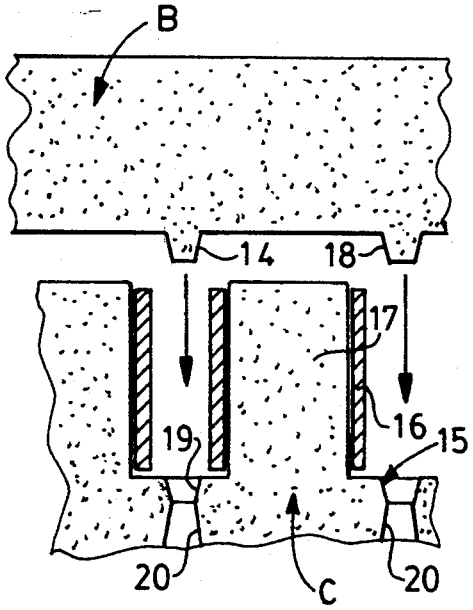
FIG. 3 is an elevational exploded schematic sketch illustrating how step two of the process is carried out.
Figure 5:
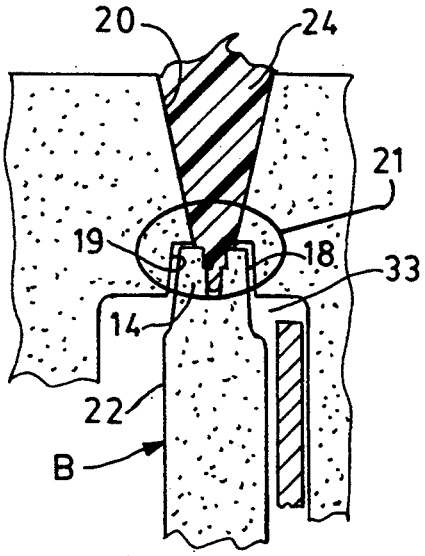
FIG. 5 is a schematic sketch illustrating how the mated parts are inverted and adhesive added to the dry mated core assembly.
Figure 4:
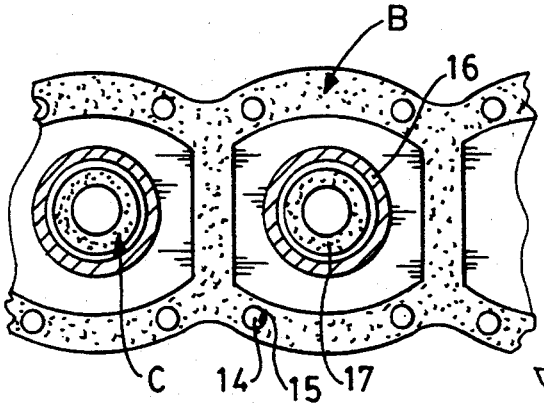
FIG. 4 is a plan view of the structure in FIG. 3.

As shown in FIG. 1, a complex core assembly 10 for defining the internal spaces of an internal combustion engine block may comprise a base core A (and in some cases a journal core and crankcase core, not shown) having pieces thereof keyed together by core prints or key ways to achieve mechanical integrity without adhesives. However, water jacket core B is relatively thin in section at 12 and must be suspended from the arms 11 of the barrel slab core C, thereby requiring a different securement here. Cores A, B and C are used in defining the internal passages and spaces that are necessary for an internal combustion engine block. The cores are formed of a suitable sand mixture employing a binder, preferably in the form of a two-part urethane resin, that is accelerated in curing by a gas catalyst. The technology for making sand cores is more fully disclosed in "Foundry Core Practice" by H. Jietert published by The American Foundryman Society, 1966 and which is incorporated herein by reference. Such technology typically comprises blowing the sand mixture into a core box having an appropriate interior cavity designed for the specific core or mold parts; the impaction from blowing forces tends to shape the sand grains into a dense condition. As the cores are assembled in sequence, base core A is placed on a platform 13 in the position it would assume when installed in a vehicle, with its base surface A-1 resting thereon so that cylinder bore walls extend upwardly.

In a preferred embodiment of this invention, the entire mold assembly as well as the core parts made of resin bonded sections, about 20 different sections or pieces. The cylinder blocks are cast one per mold assembly. The mold and core sections will all be locked without an adhesive, except the water jacket and barrel slab cores B,C which are joined with the hot melt polyamide adhesive. Thus, the last mold sections to close the mold are the glued barrel slab and water jacket cores at the top of the assembly. The feet 14 of the water jacket core C fit into a pocket or core print 15, about a ½ inch deep, on the barrel slab core. The tight nesting of the feet of the water jacket in the pockets 15 hold the water jacket in the correct position around the cylinders. In making some aluminum cylinder blocks today, iron or aluminum sleeves or liners 16 are placed around the sand core cylinders 17 so that the liners can be cast directly into the aluminum casting block and not added later in a subsequent operation. When such iron liner is cast in, the liner must be heated (such as by induction heating) to over 600° F. prior to filling the mold with molten metal. The adhesive on the water jacket is the sole means by which the hanging water jacket is held in place on the closed mold; the adhesive must not only withstand the radiated heat from the heated cylinder liners during the transfer of the core assembly to the mold and then to the mold fill station, but also withstand the heat of the molten metal during mold pouring. To assist the adhesive in not raising above 350°–390° F. after setting, the core design uses sand insulation or air spaces between the adhesive at the mating surfaces and the source of the heat (i.e., the liner heated to about 600° F.).

Water jackets cores have been heretofore bonded to the barrel slab core by use of wide flat mating surfaces with refractory pastes spread there across. Such pastes usually require long drying periods in excess of 30 minutes and such refractory pastes are weak at best. Often, the paste is squeezed out of the mating surfaces during assembly, which may cause defects in the casting if not remedied. Moreover, the paste, being a structural bridge between the core parts, can lead to inaccuracies upon heating with accompanying distortion as well as elevating manufacturing costs required to cure the paste in separate manufacturing steps.

Figure 6:
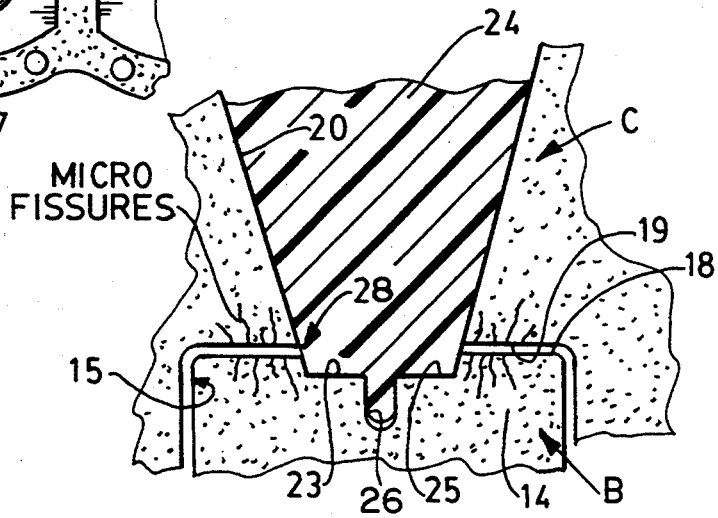
FIG. 6 is a greatly enlarged sectional view of one core print mating surfaces.

To avoid interference of the adhesive with the molding surfaces and to assure an accurate core part relationship during casting, the inventive method herein for making a sand core assembly (see FIGS. 2–7) comprises: (a) providing two or more sand core parts B,C with accurately mating surfaces 18,19 and at least one injection port 20 that intersects with a desired portion 21 of the mating surfaces 18,19, the core parts cooperating to define at least one molding surface 22; (b) mechanically dry-mating the core parts B,C together at the mating surfaces to eliminate any space therebetween except for microfissures 23 at the mating surfaces; and (c) injecting a limited quantity of quick-setting organic adhesive 24 into the port 20 with a controlled pressure effective to migrate the adhesive to the end of the port 20 and only into microfissures 23 remote from the molding surface 22. As shown in FIG. 6, the port 20 extends slightly across part of the mating surfaces 18,19 (about 0.5 inch) and extends into the core B by formation of a depression 25 in each of the feet 14 and inclusion of a slot or step 26 in the depression 25. This creates a body of adhesive that is T-shaped standing across the mating surfaces to stake and rigidify the joint in mutually perpendicular planes, as well as add additional joining surface area at location 21.

This method requires dry-joining of at least two mating sand cores prior to applying any adhesive. The dry sand cores will slip together easily since no thick adhesive is in the core print. This eliminates the requirement of pressing on the fragile core parts, such as a water jacket core, in order to properly locate it correctly into the barrel slab core print. The dry-mated cores will be in correct position dimensionally because of the dowel shaped print and feet and intermechanically supported before any adhesive is injected.

Figure 7A:
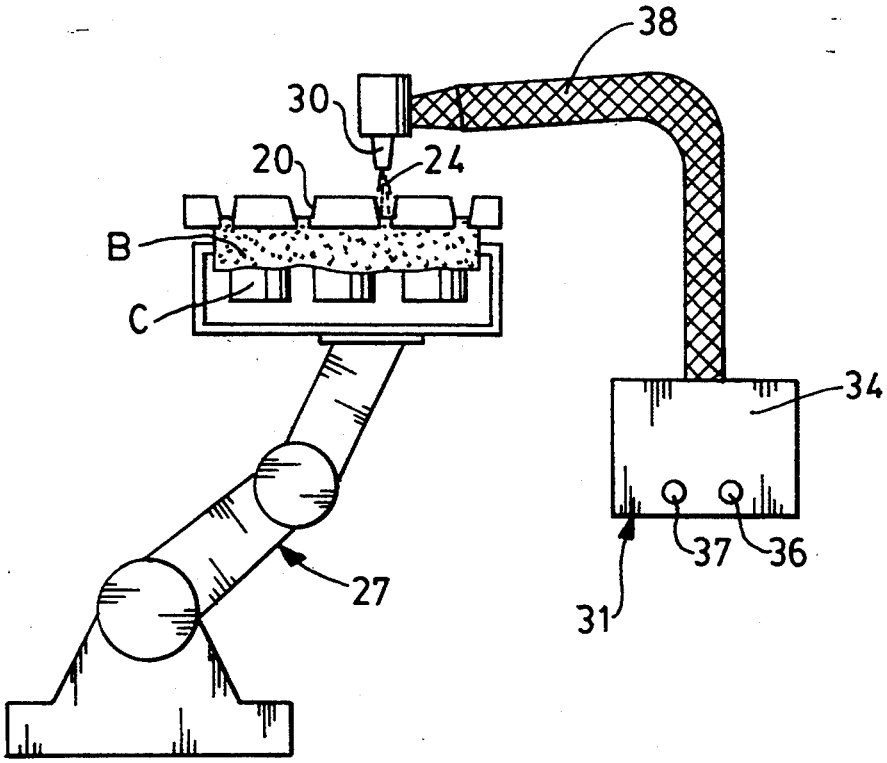
FIGS. 7A and 7B are schematic illustrations of how the dry mated, adhesively bonded core assembly is robotically injected and placed for metal casting.
Figure 7B:
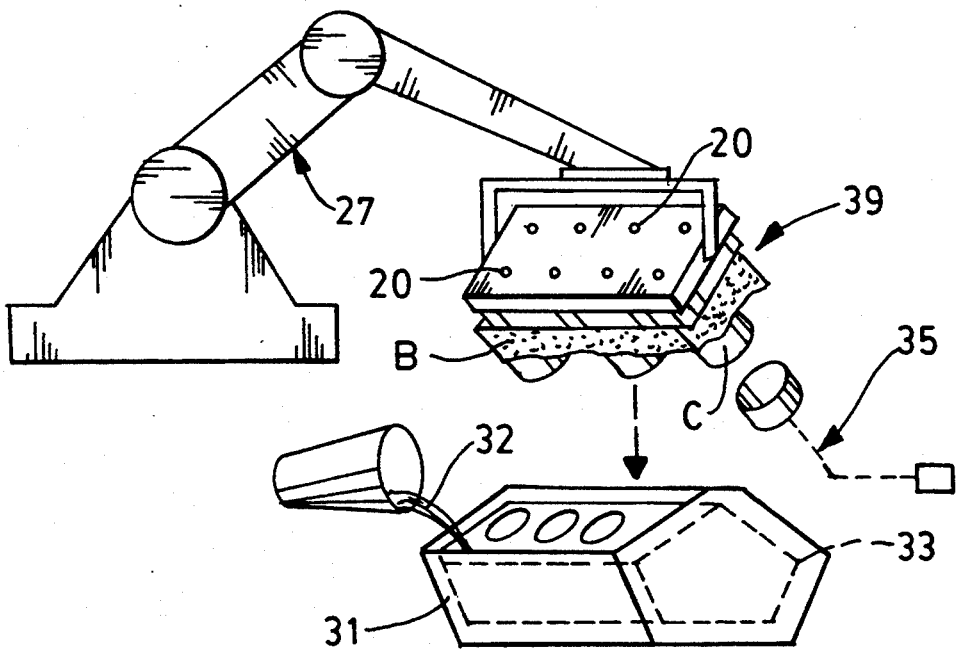

Preferably, as shown in FIG. 7A, the parts B,C are held together with a robot 27 (or in a fixture) while the hot melt polyamide adhesive 24 injected into conically-shaped ports 20 which intersect and connect with the edge 28 of the mated surfaces 18,19. Depending on the sand core to be joined, only five to eight conically-shaped ports 20 or holes are formed in the back side 29 of core part C for receiving the hot melt.

The type of adhesive that is useful in this invention preferably is a chemical composition to provide (i) a hot melt adhesive, (ii) that has heat resistance so that it will not soften at temperatures as high as 350° F., and (iii) sets or cures in less than 60 seconds. Such adhesive must be quick-setting so that it is set within a time frame of 5–60 seconds, well below the time required for prior art type adhesives that have been used in such applications. The adhesive is applied as a liquid at temperatures as high as 450° F., but after setting it should be shielded in the core design so that it will not raise in temperature above 390° F. and soften if support depends on the adhesive alone.

The shape of the ports can vary from that of being conically-shaped to that which delivers the fluid adhesive to at least the edge 28 of the mating surfaces (see FIG. 6). The other part B may be imprinted with a slot or depression 25 to allow the adhesive to extend across the mating surfaces. The sand types compatible with such an adhesive comprise at least: resin bonded silicon and zircon. The configuration of the mating surface relative to the port shape is important; at least one edge 28 of the mating surfaces (remote from any molding surfaces that define the ultimate casting) must be exposed to the port. It is this edge with which the injection port must communicate.

The volume of adhesive to be applied is now no longer a critical and unmanageable amount as with prior art techniques. The adhesive can now be applied through a nozzle 30 into each port or conical hole by automation as shown in FIG. 7A. If a robot 31 is used, it can be programmed to inject the adhesive for several different core designs without changing the assembly fixture. The adhesive injection equipment may have a adhesive melter 34 with temperature controls 36 and pressing controls 37, and a hose 38 for carrying the melted adhesive to nozzle 30. It is desirable that the adhesive be injected on the back of the core assembly so that the adhesive will never come in contact with the hot metal during mold pouring; the adhesive 24 will cease to cause any casting defect on the molding surfaces. No longer is there a worry that the adhesive will cause stringing or threads to appear and therefore create casting defects.

The amount of pressure utilized to inject the adhesive 24 is desirably that which will deliver the adhesive through the port considering the viscosity of the adhesive. The pressure will depend upon the type or viscosity of the adhesive, with the object of migrating the adhesive only into the micro-entrance fissures of the dry-mated surfaces. The viscosity of the adhesive may be varied by changing the temperature of the injection.

Another aspect of the invention is one of using the above core assembly in a metal casting operation relying on the dry-mated core parts. The method of casting metal parts using a bonded sand core assembly, comprises: (i) making two or more sand core parts B,C for assembly with accurately mating surfaces 18,19 and at least one injection port 20 in at least one core part that intersects and extends across a desired portion 21 of the mating surfaces, the core parts cooperating to define at least one molding surface 22; (ii) dry mating the core parts in the exact desired relationship with the mating surfaces 18,19 in solid contact without any space therebetween except for micro-fissures 23 at the mating surfaces; (iii) injecting a quick-setting adhesive 24 into the port 20 with a controlled pressure effective to migrate the adhesive throughout the port, but no further than the micro-fissures at one edge of the mating surfaces remote from the molding surface, said adhesive 24 having a chemical composition that resists heat up to a temperature of 350°–390° F.; (iv) after the adhesive sets, placing the adhesive injected assembly 39 (see FIG. 7B) into a mold 31 and with a metal liner planted about one of the core parts; (v) heating the liner (i.e., by inductive heating apparatus 35) while said adhesive secures said core parts together; and (vi) pouring molten metal 32 into its mold cavity 33, the weight of the cores B,C being carried by the adhesive, the adhesive maintaining adhesive integrity during liner heating, metal pouring, as well as during solidification to assure binding of the mated surfaces.

It is desirable that the dry mating of the surfaces be done with high accuracy. The setting time for the adhesive is in the range of 5–60 seconds because the softening point is so high, i.e., 390° F. with a very long chain polymers. There is a very short liquid range. If the setting time is faster than five seconds, then the cycle time is increased, the required adhesive application temperatures will be too high. If the setting time is greater than 60 seconds, then the cycle time for applying the adhesive and assembling will be excessive for economical production and will require an off-line process. This would also mean additional equipment and the need for additional handling of the cores. The one-time handling by the robot (or manually) is to apply the adhesive and set the assembly 30 in one motion, allowing only a few seconds during movement of the cores to the correct position. The robot 27 holds the cores B,C together during the adhesive application but does not set the cores down into the mold during the 5–60 second setting time, depending on the amount and character of the adhesive. Setting time will also vary depending on the thermal conductivity of the adhesive which is relatively poor; the adhesive can be applied as a liquid at temperatures as high as 450° F.

I claim:

1. A method of making a sand core assembly, comprising:

(a) providing two or more sand core parts with accurate mating surfaces and at least one injection port in at least one of said core parts that intersects with a desired portion of the mating surfaces, said core parts cooperating to define at least one molding surface;

(b) mechanically mating said core parts together at said mating surfaces to eliminate any space therebetween except for micro-fissures at the mating surfaces; and (c) injecting a limited quantity of quick-setting organic adhesive into said port with a controlled pressure effective to migrate some of the adhesive into said micro-fissures spaced from said molding surface.

2. The method as in claim 1, in which said adhesive sets within a period of less than 60 seconds.

3. The method as in claim 1, in which said adhesive consists essentially of an organic polyamide high molecular weight thermoplastic resin.

4. The method as in claim 1, in which said port extends slightly across the mating surfaces.

5. The method as in claim 1, in which said mating surfaces are defined by tapered feet of one core part fitting within tapered openings of the other core part.

6. The method as in claim 1, in which the pressure of injection is sufficient to force fluid adhesive through the port, the viscosity of said adhesive being in the range of 2,000 centipoise to 5,000 centipoise.

7. A method of casting metals, comprising:

(a) making two or more sand core parts for assembly at predetermined accurate mating surfaces, at least one of said core parts having an injection port that intersects with the desired portion of the mating surfaces, the core parts cooperating to define at least one molding surface separate from said mating surfaces but adjacent thereto;

(b) dry mating said core parts in an exact desired relationship to eliminate any space therebetween except for limited micro-fissures at the mating surfaces;

(c) injecting a limited quantity of quick setting adhesive into said port with a controlled pressure effective to migrate the adhesive throughout the port but no further than the micro-fissures spaced from said molding surfaces, said adhesive being the sole support and bond between said cores; and (d) after the adhesive has set, placing the adhesive injected assembly into a mold and pouring molten metal into the mold cavity of said mold for contacting said molding surface, said mold chilling said metal and forming a cast metal part defined in part by said core assembly.

8. The method as in claim 7, in which during step (d), a metal liner is placed around one of the core parts separated but adjacent to said mating surfaces and heated prior to pouring said molten metal.

9. The method as in claim 7, in which said adhesive is a resin consisting essentially of polyamide.

10. The method as in claim 7, in which said mold in step (d) is effective to form an engine block for an automotive application, said core parts defining at least a barrel slab core and a water jacket core suspended from said barrel slab core for said assembly.

11. The method as in claim 8, in which said method further comprises, in step (d), heating parts of said assembly by induction heating and by the heat of said molten metal whereby such adhesive is the sole support between said cores during such heating by induction and during molten metal pouring.

* * * * *